United States Patent [19]

Harbeke

[11] Patent Number: 4,619,087

[45] Date of Patent: Oct. 28, 1986

[54] BARRIER-EMBEDDED PIPE-COUPLING APPARATUS AND METHOD

[76] Inventor: Gerold Harbeke, 2807 S. Military Trail, West Palm Beach, Fla. 33415

[21] Appl. No.: 729,495

[22] Filed: May 1, 1985

[51] Int. Cl.[4] ..... E04G 5/48

[52] U.S. Cl. ..... 52/221; 52/699; 52/577; 285/64

[58] Field of Search ..... 52/221, 699, 701, 577; 285/56, 64

[56] References Cited

U.S. PATENT DOCUMENTS

| | | | |
|---|---|---|---|
| 395,061 | 12/1888 | Kellogg . | |
| 1,309,084 | 7/1919 | Zimmerman . | |
| 1,391,988 | 9/1921 | Zents . | |
| 1,712,895 | 5/1929 | Metcalf . | |
| 1,746,696 | 2/1930 | Dows . | |
| 1,767,834 | 6/1930 | Carlson . | |
| 1,851,339 | 3/1932 | Williams . | |
| 1,908,796 | 5/1933 | Suchan . | |
| 2,234,784 | 3/1941 | Stolz | 25/128 |
| 2,249,824 | 7/1941 | Hall . | |
| 2,314,866 | 3/1943 | Bosco | 25/131 |
| 2,694,847 | 11/1954 | Christiansen . | |
| 2,968,855 | 1/1961 | Stolz | 25/128 |
| 3,294,358 | 12/1966 | Hagedorn | 249/175 |
| 3,346,230 | 10/1967 | Tolf, Jr. | 249/177 |
| 3,523,552 | 8/1970 | Ogden | 137/592 |
| 3,594,021 | 7/1971 | Williams et al. | 285/302 |
| 3,821,338 | 6/1974 | Faust | 264/35 |
| 4,079,912 | 3/1978 | Haydock | 249/184 |
| 4,118,906 | 10/1978 | Preuninger et al. | 52/699 X |
| 4,159,099 | 6/1979 | Maguire | 249/93 |
| 4,170,853 | 10/1979 | Kohaut | 52/99 |
| 4,223,740 | 9/1980 | Clayton | 169/70 |
| 4,261,598 | 4/1981 | Cornwall | 285/56 |
| 4,427,173 | 1/1984 | MacKay | 249/39 |
| 4,453,354 | 6/1984 | Harbeke | 52/220 |

FOREIGN PATENT DOCUMENTS 2615428 4/1978 Fed. Rep. of Germany .

*Primary Examiner*—Carl D. Friedman

*Attorney, Agent, or Firm*—Griffin, Branigan, & Butler

[57] ABSTRACT

A support apparatus and method for attaching fluid-conveying pipe couplings of various lengths to be embedded in concrete barriers (30, 80, 172) of various thicknesses to a metal concrete form (26) involve a dual diameter outer disk (34) attached to an elongated compressing column (32) which extends through a hole (54) in the concrete form to a fastening means (38) in order to compress the fluid conveying pipe couplings (24) in fixed positions between the form and the outer disk. The fastening means can be attached to the compressing column at virtually any longitudinal positions. An inner disk (36) can also be put between the form wall and an inner end of the pipe coupling to provide extra rigidity. The disks act as forms to produce openings in the concrete barriers at opposite ends of the pipe couplings (24). Nothing extends beyond an outer, perimeter, surface of a forming portion of the outer disk. A preferred coupling assembly with which the support apparatus is used, and a method of using the same, involves a male/-male, relatively short, insert having an O-ring seal and a tapered internal surface at only one end to form a sliding seal with a female/female pipe coupling portion embedded in the concrete barrier. A hand grip is formed on the outside surface of the insert.

1 Claim, 10 Drawing Figures

FIG. 1 (PRIOR ART)
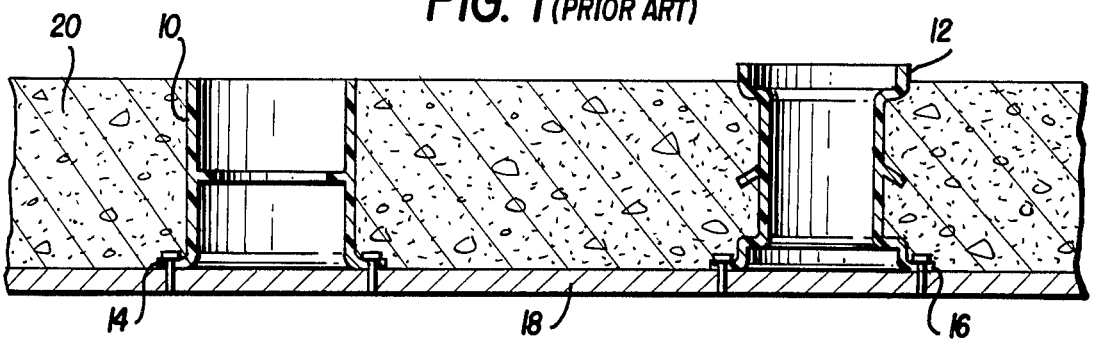
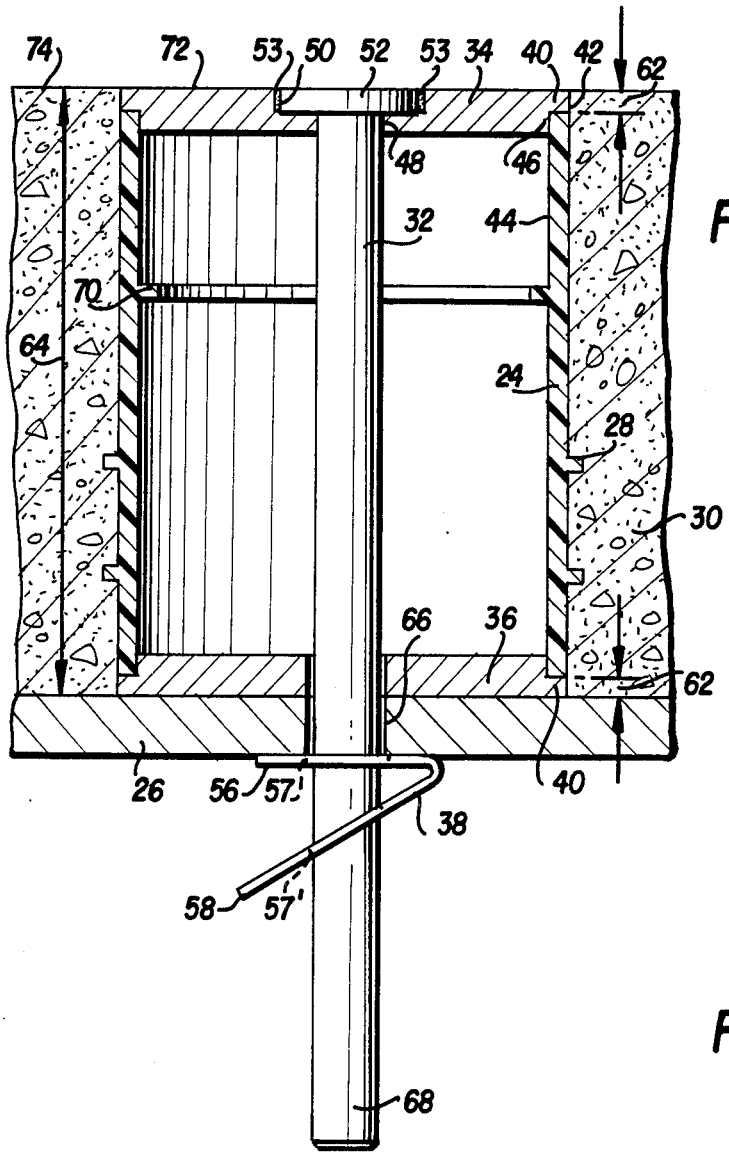
FIG. 2
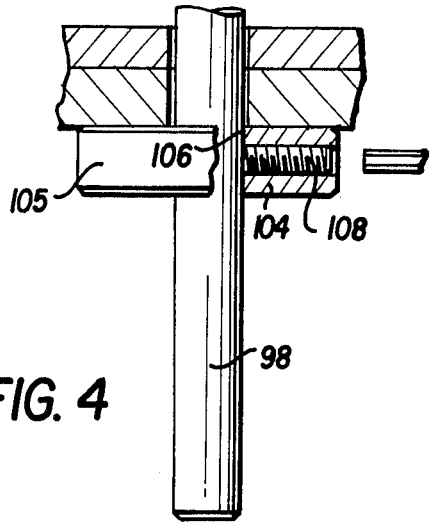
FIG. 4

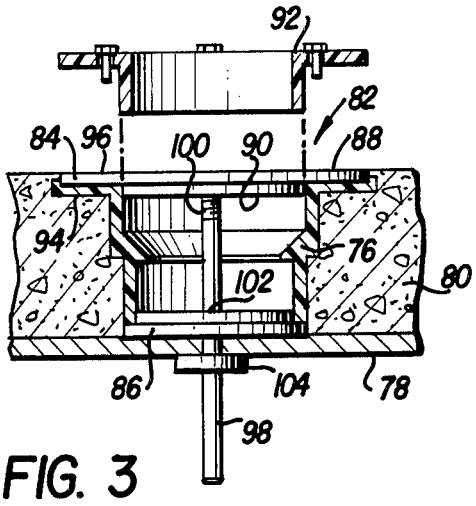
FIG. 3
FIG. 5
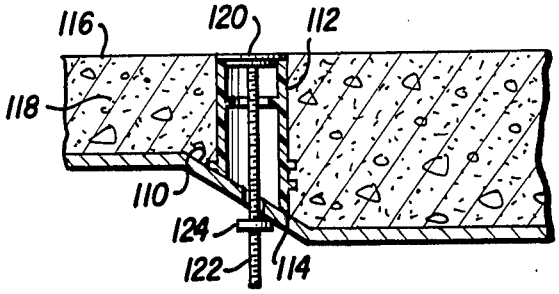
FIG. 6
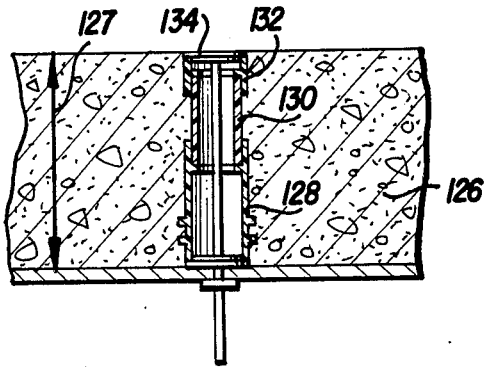
FIG. 7
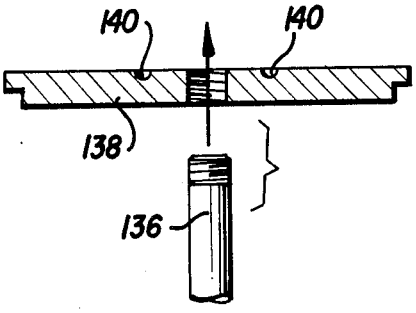
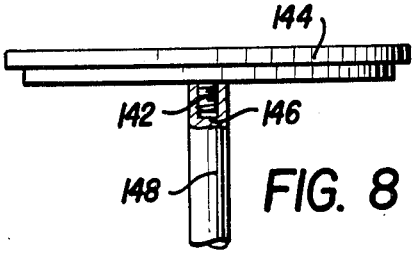
FIG. 8
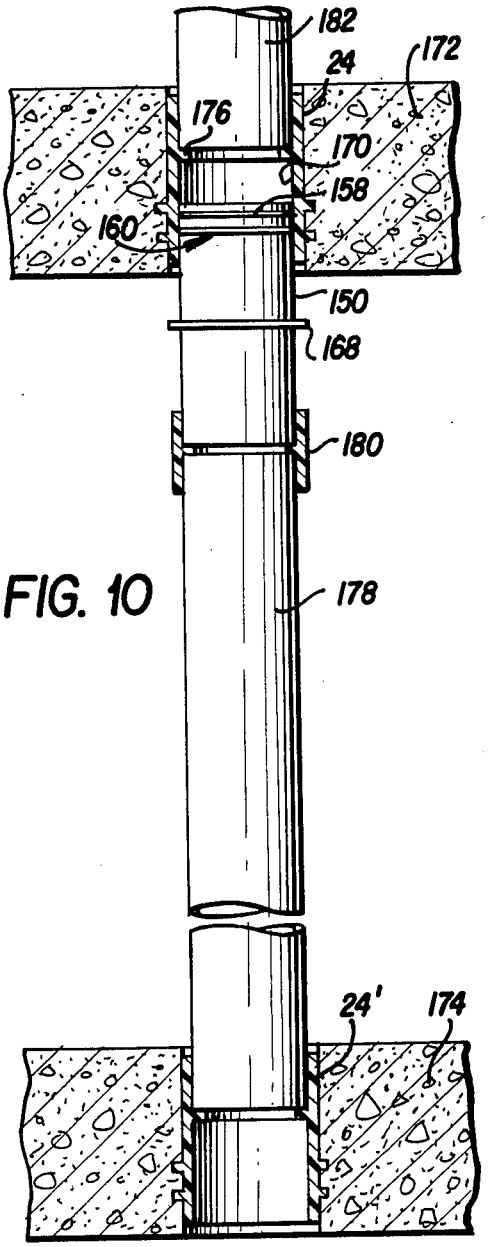
FIG. 10

BARRIER-EMBEDDED PIPE-COUPLING APPARATUS AND METHOD

BACKGROUND OF THE INVENTION

This invention relates generally to the art of fluid-conveying pipe coupling joints (couplings) which are embedded in concrete barriers, especially floors, when the barriers are formed and then coupled to pipes on opposite sides for forming an integral part of a fluid flow system. More particularly, this invention concerns an integrated system including a pipe coupling joint to be embedded in a barrier, an apparatus and method for holding the coupling joint in the barrier during its forming, and an apparatus and method for attaching the coupling joint to an adjacent fixed pipe which cannot be moved longitudinally.

Until relatively recently, pipe networks were normally extended through floors of buildings by forming holes in the floors—e.g. by using void forming devices during the "pouring" of the floors, by knocking out holes, by boring such holes after the floors had been formed, etc.—and thereafter extending pipes through these holes. Normally, the holes were made to be bigger than the pipes to ensure that one could put pipes easily through the holes. Thereafter, it was necessary for workmen to fill the spaces between the pipes and the holes with cement or some other substance in order to meet fire codes which generally do not allow holes in floors.

Within the last few years, there have been a number of patents issued, such as Harbeke (4,453,354) and Cornwall (4,261,598) for the concept of cementing pipe coupling joints into building barriers, such as floors, when the floors are poured and thereafter, mating external pipes to female opposite ends of the embedded coupling joints. Such practice is normally carried out with plastic pipe, however, it could also be carried out with pipes made of other materials.

A number of problems arise when one attempts to cement pipe coupling joints into cement floors because it involves various types of workmen at a building site. For example, steel forms and cement pourings are often carried out by specialized companies who are not related to workmen involved with piping. Most steel forms are intended for use over and over. Of course the pipe coupling members to be embedded in the concrete cannot be nailed to steel forms and most owners of steel forms jealousy protect the integrity of their forms. Thus, it is an object of this invention, to provide a support apparatus for attaching a fluid conveying pipe coupling joint (coupling) to a steel form which does not require an undue number of holes in the form.

Yet another problem which arises in trying to embed fluid-conveying pipe couplings in concrete barriers of buildings is that the depths of the barriers are often different, ranging anywhere from 4 inches to 10 inches, so that various size pipe couplings for installation in the various size barriers must be stockpiled. Therefore, it is another object of this invention to provide a single support apparatus and method which can be used for virtually all-depth barrier concrete pours and which can be used with couplers which can be fashioned on site to virtually any desired length for fitting an intended concrete pour.

Closely allied with the immediately above described problem is the problem that concrete floors are usually processed immediately after curing by large machines which must travel across the upper surfaces of the floors. This is usually carried out by concrete workers before support apparatus for embedded pipe couplings can be removed by pipe workers. For this reason, it is an object of this invention to provide a support apparatus and method for attaching a fluid-conveying pipe coupling to a form which does not extend outwardly beyond the surface of a barrier being made by the form.

One major difficulty which arises when one embeds pipe couplings in poured concrete barriers is that the couplings have fixed positions so that if one wishes to extend a pipe between two adjacent embedded pipe couplings one must provide a special expansion joint or coupling in the pipe to allow its end to be moved longitudinally into the wall embedded couplings. Such expansion couplings are specialized members which are quite expensive to purchase and to stockpile. Thus, not only must one purchase and maintain a stock of relatively expensive embedded coupling members but one must also purchase and maintain a stock of relatively expensive expansion joints for the pipe extending between barriers. Thus, it is an object of this invention to provide a concrete wall coupling assembly which makes unnecessary the use of special expansion joint couplings for use in pipes extending between barrier embedding couplings.

It is a further object of this invention to provide a combination method and an apparatus which are relatively cost effective, time saving, and effective in operation for using fluid-conveying pipe couplings embedded in building barriers and for thereafter attaching pipe extending between such barriers thereto.

SUMMARY

According to principles of this invention, an apparatus and method for supporting a fluid-conveying pipe coupling on a concrete form wall involves an outer disk having a compression column attached thereto. The compression column extends through a single hole in the form to which a fastening means is attached at a longitudinal position on the other side of the form wall to fixedly compress the fluid-conveying pipe coupling between the disk and the form wall. The disk is shaped to inset the pipe coupling from a surface of a barrier to be formed and to shape an opening in the barrier for allowing outside pipes to be easily engaged with the pipe coupling at its opposite ends. The outer disk has an outer perimeter with a thickness for shaping this insetting hole in the concrete with an outer surface which is in a plane of the barrier to be formed and with no part of the supporting apparatus extending beyond this plane. The column is at least 10 inches long and in a preferred embodiment it is at least 12 inches long so that the support apparatus can be used with barrier thicknesses and pipe-coupling lengths of sizes ranging from 4 to 10 inches. A second disk can be placed between the form and the pipe coupling for adding extra rigidity to the support of the pipe coupling.

A pipe coupling used with this invention includes a separate, relatively short, expansion pipe insert having a slidable O-ring seal and an internally tapered surface at one end thereof, with the other end being formed in the same manner as a normal pipe. According to this apparatus, and a method with which it is used, the O-ring end of the insert is inserted into, and thereby sealed to, one end of the embedded portion of the pipe coupling but it can still be moved longitudinally therein while maintaining this seal so as to allow the other end of the insert to be coupled to a rigidly positioned pipe using a normal double sleeve pipe coupling.

BRIEF DESCRIPTION OF THE DRAWINGS

The foregoing and other objects, features, and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

FIG. 1 is a side sectional view of prior art fluid-conveying pipe coupling joints mounted on wooden forms and embedded in a concrete floor;

FIG. 2 is a side, partially sectional, view of a support apparatus and a fluid-conveying pipe coupling of the method and apparatus of this invention mounted in a steel form and embedded in a concrete floor;

FIG. 3 is a side, partially sectional, partially exploded, view of another embodiment of the support apparatus of FIG. 2 shown holding a drain flange;

FIG. 4 is an enlarged, partially sectional, view of a portion of the structure shown in FIG. 3;

FIG. 5 is a side, partially sectional, view illustrating another method of using of the support apparatus of FIGS. 2 and 3;

FIG. 6 is a side, partially sectional, view illustrating another method of using of the support apparatus of FIGS. 2 and 3;

FIG. 7 is a side, partially sectional view of a detail of an alternate embodiment of the supporting apparatus of FIGS. 2 and 3;

FIG. 8 is a side, partially sectional view of a detail of an alternate embodiment of the supporting apparatus of FIGS. 2 and 3;

FIG. 10 is a side sectional view of the coupling assembly of FIG. 9 shown connecting pipes between two barriers. cl DESCRIPTION OF THE PREFERRED EMBODIMENT In the prior art, two types of fluid-conveying pipe couplings 10 and 12 (FIG. 1) have flanges 14 and 16 thereon which are nailed to a wooden concrete form wall 18. Concrete 20 is then poured to embed the couplings 10 and 12 in the concrete 20. As has already been explained, when the forms 18 are steel, nails cannot be used and form owners do not like undue numbers of holes in the forms. Also, with this prior art arrangement one must use various size couplings for various depth pours.

With reference to FIG. 2, an unusual support apparatus 22 is shown for rigidly compress-supporting a female/female plastic pipe coupling 24 to a steel form 26. The pipe coupling 24 has annular anchors 28 extending about the outer surface thereof to prevent longitudinal movement withing concrete 30 once it has cured.

Figure 9:
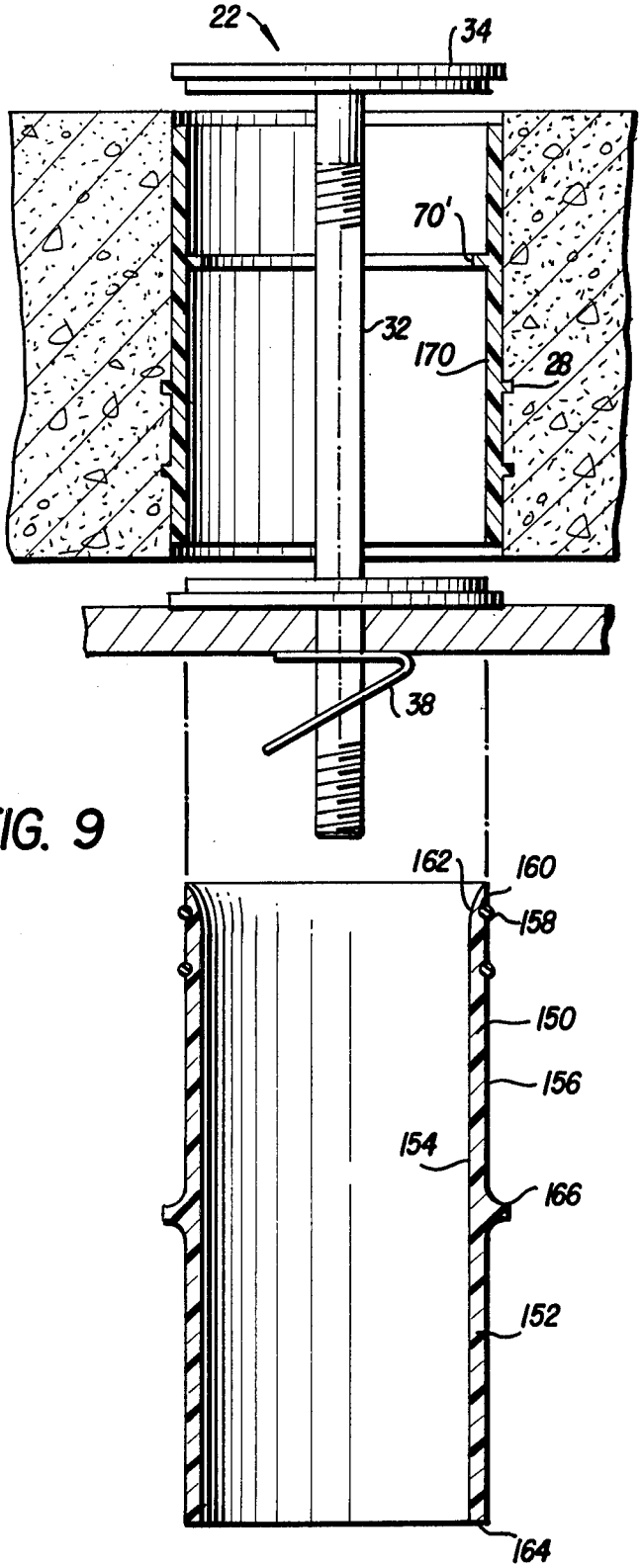
FIG. 9 is a side, partially sectional, exploded view of those elements of FIG. 2 but also with an insert portion of a coupler assembly to be used with a method of this invention for attaching pipes between two barrier-embedded pipe couplings.

The support apparatus 22 comprises an elongated compression column 32, an outer double diameter disk 34, an inner double diameter disk 36, and a fastening member 38.

The outer disk 34 has an upper flange 40 with a circular outer perimeter 42 which has a diameter which is larger than the diameter of an internal bore 44 of the pipe coupling 24. A circular plug portion 46 of the outer diameter disk 34 has a diameter which is the same, or slightly smaller than the diameter of the internal bore 44 of the pipe coupling 24 so that it can be snugly inserted into the outer end thereof as is shown in FIG. 2 to provide rigidity between these two members. There is a countersunk hole 48 passing through the center of the outer double diameter disk 34 whose countersunk notch at 50 receives a head 52 of the elongated compression column 32 so that the head does not extend beyond the outer surface of the outer disk. The head 52 is welded to the disk 34 at 53 to provide rigidity between the compression column 32 and the outer disk 34.

The inner double diameter disk 36 has a structure which is exactly the same as the structure of the outer double diameter disk 34 with the exception that a hole 54 passing through the center thereof does not need to be counter sunk as is the hole 48, although it could be in order to provide interchangeablity of parts. Further, the compression column 32 is not welded or otherwise attached to the inner disk 36.

In the depicted embodiment, the elongated compression column 32 is an alluminum cylindrical shaft whose head 52 is integral therewith. The shaft is at least 10 inches long and is preferably around 12 inches long. The inner and outer disks 34 and 36 are also formed of aluminum.

The fastening member 38 depicted in FIG. 2 is merely a spring clip having two hingedly attached members 56 and 58, each respectively having a hole 57 and 57' therein through which the elongated cylindrical shaft 32 extends and each being biased hingedly away from the other so that the fastening members 38 binds itself on the elongated compression column 32. In this respect, the fastening member 38 can be loosened from the elongated compression column 32 by simply pressing the members 56 and 58 together. The fastening member 38 can then be slid along the column and it can be again clamped in any position along the column by simply allowing the mebers 56 and 58 to be biased away from one another. In one embodiment the fastening member is attachable to the compression column at all locations between its lower most tip to a point $4\frac{1}{4}$ inches from the top of its head 52. This is to allow the use of the support apparatus with a form of $\frac{1}{4}$ inch steel for pours ranging from 4 inches on up, however, in the preferred embodiment the range of fastening need extend only to about 5 inches from the top of the head 52 since most forms are thicker than $\frac{1}{2}$ inch.

In operation of the support apparatus of FIG. 2, one who is responsible for attaching pipe couplings 24 to a form wall 60 for making a pour of concrete 38 of a particular depth selects (which might include fashioning) the pipe coupling 24 of a length such that when this length is added to thicknesses 62 of the flanges 40 it equals the thickness 64 of the pour 30. In this respect, the support apparatus 22 of this invention can be used with a pour of any thickness, one must simply cut off, or add to (as will be further explained below) the length of the pipe coupling 24 to make the pipe coupling with its end disks the same as the depth, or thickness of the pour. Thereafter, one must bore one hole 66 in the form wall 60 at the position at which he intends to mount the pipe coupling 24. The plug portions 46 of the outer and inner double diameter disks 34 and 36 are inserted into opposite ends of the pipe coupling 24 with the elongated compression column 32 being placed through hole 54 of the inner disks 36, while its head 52 is attached to the outer disk 34. The opposite end 68 of the compression column 32 is extended through the hole 66 in the form 60 and the fastening means 38 is attached to the elongated compression column 32 at a position contacting the form 26 with the compression column end 68 being pulled away from the form 60 so as to fixedly compress the pipe coupling 24 between the outer double diameter disk 34 and the form wall 60, with of course, the inner disk 36 being therebetween.

As it will be appreciated, the supporting apparatus of this device only requires one hole in the form and this same hole, with the supporting apparatus of this invention can be subsequently used for supporting pipe couplings of different sizes for different pours. Since the fastening means 38 can be attached at any usable position along the elongated compression column 32, this column, along with disks 34 and 36, and the fastening means 38, can be used for many different-depth pours.

It should be noted that the upper flange 40 of the outer disk 34 and the lower flange 40' of the lower disk 36 actually create circular disk forms above and below the pipe coupling 24 which produce holes between opposite surfaces of the concrete barrier 30 and the ends of the pipe coupling 24 to allow access for pipes introduced into the coupling 24 from outside the barrier. Through these holes molded in the concrete by the outer perimeters 42 of the flanges 40 and 40' pipes (not shown in FIG. 2), are inserted into the internal bore 44 from opposite ends, each being prevented from going beyond an annular rim 70 which is integral with the pipe coupling 24 and which rises from the internal bore 44.

It should also be noted that an outer surface 72, beyond the thickness 62 of the flange 40, is in the plane of the upper surface 74 of the concrete barrier 30 (floor) and that there is nothing extending upwardly from the support apparatus 22 above the barrier surface 74. This is important so that concrete machines working the upper surface of the barrier 74 are not impeded by the supporting apparatus 22.

Once the concrete 30 has cured and its surface 74 has been machined, the individual responsible for the pipes removes the fastener 38 and drives the compression column 32 from its end 68 upwardly, as seen in FIG. 2, so as to drive the outer disk upwardly and out of the concrete barrier 30. If any concrete has formed over the outer disk 34 this is knocked off by the driving of the compression column 32. The inner disk 36 can be knocked out from the other side after the outer disk 34 has been removed and after the form 26 has been removed. The inner disk 36 is generally easier to remove than the outer disk 34 because the form 26 prevents concrete from forming around it.

FIG. 3 depicts a modified support apparatus similar to that of FIG. 2 and further illustrates the method of this invention. In FIG. 3 is shown a plastic drain flange 76 which is being held on a form 78 by a support apparatus in accordance with the method of this invention while a shower, or the like, cement floor 80 is poured. The support apparatus 82 is basically the same as the support apparatus 22 of FIG. 2 with the exception that an outer double diameter disk 84 is much larger than an inner double diameter disk 86 to accommodate the shape of the drain flange 76 and it also has a much larger flange 88 relative to a plug member 90. This larger flange 88 forms a hole in the cement floor 80 for a clamp 92 which is screwed to a mounting ring 94 to clamp a drain tub (not shown) therebetween. Again, the concrete of the floor 80 is poured to the upper surface 96 of the outer double diameter disk 84. Yet another difference between the support apparatus of FIG. 3 and FIG. 2 is that an elongated compression column 98 of the FIG. 3 embodiment does not have a head as the head 52 in the FIG. 2 embodiment but rather has external threads 100 which screw into internal threads of the outer double diameter disk 84. The elongated compression column 98 still passes through an unthreaded hole 102 of the inner double diameter disk 86. Still another difference is in the fastening member 104 of FIG. 3 which is shown in more detail in FIG. 4. Rather than being a spring clip as is shown in FIG. 2, the fastening member 104 is a block 105 having a hole 106 through which the compression column 98 extends with an Allan-wrench driven set screw 108 to allow the fastening member 104 to be released from and moved along the elongated compression column 98 to be set at any desired position. This device is basically used in the same manner as the FIG. 2 embodiment with the outer disk 84 being knocked out of the concrete by driving the compression column 98 upwardly.

Looking at a method of utilizing the support apparatus of FIG. 2 with a floor form having an inclined surface 110 (FIG. 5), here, an embedded plastic pipe coupling 112 has been cut at an angle at 114 in order to correspond with the slope of an inclined form surface 110 so that the pipe coupling 112 is perpendicular to a surface 116 of a concrete floor 118. Here no inner double diameter disk such as is indicated by 36 in FIG. 2 need be utilized inasmuch as this would require special disks for all possible slopes, which would be impractical, however, it must be understood that some rigidity in support for the pipe coupling 112 is given up by not using an inner double diameter disk. In this case, the pipe coupling 112 is compressed between an outer double diameter disk 120 and the form inclined surface 110 by an extremely coarse, externally-threaded, elongated compression column 122. In this case, a fastening means 124 is a nut having extremely coarse internal female threads corresponding to the coarse male threads of the compression column 122 to allow the fastening means 124 to be quickly positioned at virtually any position along the elongated compression column 122. Again, the support apparatus of this invention is extremely flexible in use in that it can be used with inclined form walls for various depth pours by simply cutting a coupling 112 at a work site to a proper length. Again, it can be seen that an outer surface of the outer double diameter disk 120 is in the plane of the floor surface 116 and molds a hole between this surface and the end of the pipe coupling 112. No part of the supporting apparatus is above the floor surface 116.

Yet another method of using the support apparatus shown in FIGS. 2, 3, and 5 is illustrated in FIG. 6 where a concrete floor is to have a much greater thickness 127 than could be serviced by a relatively short embedded coupling 128 which is handy to a workman. The support apparatus of this device allows the workmen to "add on" to the embedded pipe coupling 128 by using a short length of pipe 130 and a normal double sleeve pipe coupling 132 which a workman usually has at the work site. By "adding on" to the pipe coupling 128 in this manner, a workman can make an embedded coupling of virtually any desired length with parts he has on hand.

The normal double-sleeve coupling 132, the length of pipe 130 and the pipe coupling 128 are attached by means of an adhesive, or are fuse bonded. But no matter what the length, the composite embedded coupling can be accommodated by the variable length support apparatus 134 which is constructed and utilized in the same manner as those embodiments already described above.

FIG. 7 depicts an alternate embodiment in which a compression column 136 is screwed to an outer disk 138 and the outer disk 138 also has engagement holes 140 therein to enable one to engage the disk 138 and unscrew it from the compression column 136 from outside the barrier to release the support apparatus from the barrier.

In the FIG. 8 alternate embodiment, a male threaded stub 142 is integral with an outer disk 144 to engage the female threads 146 of a compression column 138. Again, the outer disk 144 could have engagement holes similar to those indicated at 140 in FIG. 7 to allow removal of the support apparatus from that side of the barrier.

Referring now to FIG. 9, a particular pipe coupling assembly is shown for use with the support apparatus of FIGS. 2–8. In this pipe coupling assembly, the embedded pipe coupling member 24 is substantially the same as was described for FIG. 2 and therefore the same reference numerals will be used for similar components thereof as was used in FIG. 2. It is noted that a rim 70' is located more toward the upper end of the coupling 24 in the FIG. 9 embodiment than for the coupling 24 in FIG. 2. In addition to the female/female embedded pipe coupling member 24, a relatively short, external, male/-male insert 150 forms a part of the assembly. The insert 150, in practice, is less than 10 inches long and can be sold as a set with the embedded pipe coupling 24. The insert 150 has a cylindrical wall 152 with internal and external surfaces 154 and 156. At only one end thereof, there is at least one O-ring 158 mounted in an annular groove 160 formed in the external surface 156, although there can be more O-rings and grooves as is shown in FIG. 9. Also at this same end, the internal surface of the wall of the insert 150 is tapered at 162 toward the other end from the external surface 156 to the internal surface 154. The cylindrical wall 152 is approximately the same size as a normal pipe which is to be coupled to the embedded pipe coupling 124. The other end 164 of the insert 150 is blunt in the same manner as a normal pipe. A laterally-extending hand grip 166 is mounted on the external surface 156 of the insert 150 to enable one to better grip the small insert for moving the O-rings 158 into and out of an internal bore 170 of the pipe coupling 24.

The method of using the pipe coupling assembly of FIG. 9 will now be described with reference to FIG. 10. First, the embedded pipe coupling member 24 is cemented into a building barrier (floor) 172 using the support apparatus of FIG. 2 as was previously described. A second pipe coupling member 24' is similarly embedded in an adjacent barrier (floor) 174. After the forms and support apparatus have been removed from the barriers 172 and 174, it is desired to extend pipe between the embedded pipe couplings members 24 and 24'. As can be appreciated, it would be impossible to place a single pipe between these embedded pipe couplings members because the pipe would be too long to move it into place between the barriers 172 and 174 for then moving it longitudinally into the couplings. Instead, that end of the insert 150 having the O-rings 158 and the inclined internal surface 162 thereon is inserted into the lower end of the pipe coupling 24 as is shown in FIG. 10. The O-rings form a seal with the bore 170 of the pipe coupling 24 immediately upon entering. Thereafter, however, using the hand grip 168, the insert 150 is forced much further up into the internal bore 170 until the upper end of the insert contacts an internal rim 176 within the bore 170. At this point, there is sufficient room to place a pipe 178 into the upper end of the embedded coupling member 124' and move it into alignment with the insert 150. Now a normal double sleeve coupling 180 can be placed on the upper end of the pipe 178 and, by using the hand grip 168, the insert 170 can be moved downwardly into the other end of the double sleeve coupling 180 to form a coupling between the pipe 178 and the insert 150. The O-ring 158 at the other end of the insert 150 maintains its seal with the embedded pipe coupling 24. The insert 150 and pipe 178 are bonded to the double sleeve coupling 180 and the pipe 178 is bonded to the upper end of the bore of pipe coupling 24'.

It will be appreciated by those skilled in the art that the pipe coupling assembly of FIGS. 9 and 10 avoid the use of an expensive expansion joint in addition to an embedded pipe coupling member and is therefore cheaper in practice than prior art devices. In addition, this pipe coupling assembly is easier to use than prior art devices. The inclined inner surface 162 at the upper end of the insert 150 allows the free flow of fluids from an upper external pipe 182 to the insert 150 without creating an obstruction to catch any of these fluid materials.

While the invention has been particularly shown and described with reference to preferred embodiments, it will be understood by those skilled in the art that various changes in form and detail may be made therein without departing from the spirit and scope of the invention. For example, the compression column and disks need not be made out of aluminum but rather many other materials could be used.

The embodiments of the invention in which an exclusive property or privilege are claimed are defined as follows:

1. A combination support apparatus and concrete wall pipe coupling comprising:

an elongated, cylindrically-shaped, female/female pipe coupling to be embedded in a concrete barrier, said pipe coupling having an elongated tubular shape and having integral female pipe receiving elements at opposite ends thereof, said pipe coupling including an anchor protrusion on the outer surface thereof for preventing longitudinal movement of said pipe coupling in said concrete barrier;

a support apparatus for attaching the fluid-conveying pipe coupling to be embedded, in the concrete barrier to a wall of a concrete form while the concrete is being poured and cures, said support apparatus comprising:

an outer rigid disk for engaging an outer end of the fluid-conveying pipe coupling which is furthest from said wall of said form;

an elongated compressing column attached to said outer disk for extending through said fluid conveying pipe coupling and through a hole in said wall of said form, said outer disk having a size for contacting an outer end of said pipe coupling and forcing it toward said form wall, said elongated compressing column having a length such that when it is pulled through said hole in said form so that said outer disk pulls said pipe coupling rigidly against said form wall a significant portion of said compressing column extends from the other side of the form wall; and, a fastening means for attaching to said significant portion of said compressing column at any longitudinal position on the other side of said form wall for abutting against said other side and thereby holding said fluid conveying pipe coupling rigidly compressed in a fixed postion between said form wall and said disk during the pouring and curing of said concrete;

a special relatively-short, male/male expansion insert for coupling to one end of said female/female pipe coupling, said expansion insert having a tubular shape with internal and external wall surfaces, of fixed diameters, said fixed diameter of said external wall surface being such that either end of said special expansion pipe insert fits snugly into one end of said pipe-coupling, with the external wall surface at only one of said ends having at least one circumferential groove formed therein with an O-ring positioned in said groove for forming a seal with said pipe-coupling when said only one end of said expansion insert is inserted therein and for maintaining said seal as said only one of end of said expansion insert is moved longitudinally therein, said relatively short, expansion insert having a handgrip ridge mounted on the outer surface thereof to allow one to more easily grip said relatively short expansion-pipe insert;

whereby said support apparatus can be used to mount said elongated pipe coupling on a form to embed it in a building barrier and thereafter said special expansion insert can be used to attach the pipe coupling to an external rigidly positioned pipe.

* * * * *